United States Patent [19]

Borgstrom

[11] 4,210,381

[45] Jul. 1, 1980

[54] ELECTRICAL CONNECTOR CONTACTS

[75] Inventor: Alan D. Borgstrom, Hackettstown, N.J.

[73] Assignee: Amerace Corporation, New York, N.Y.

[21] Appl. No.: 938,074

[22] Filed: Aug. 30, 1978

[51] Int. Cl.[2] ..... H01R 3/02

[52] U.S. Cl. ..... 339/115 C; 339/143 R; 339/276 T; 339/278 C

[58] Field of Search ..... 339/115 C, 111, 97 C, 339/143 R, 276 T, 276 R, 278 C

[56] References Cited

U.S. PATENT DOCUMENTS

| | | | |
|---|---|---|---|
| 2,868,863 | 1/1959 | Cook | 339/278 C X |
| 3,876,280 | 4/1975 | Jones et al. | 339/278 C X |
| 3,883,208 | 5/1975 | Sankey et al. | 339/111 X |
| 3,930,709 | 1/1976 | Stanger et al. | 339/111 |

*Primary Examiner*—Roy Lake
*Assistant Examiner*—DeWalden W. Jones
*Attorney, Agent, or Firm*—Richard A. Craig; Arthur Jacob

[57] ABSTRACT

Electrical connector contact elements in which a tubular member of an aluminum material is captured within a surrounding member of a copper material, the tubular member having a bore for receiving a cable conductor to which the contact element will be crimped and the surrounding member including a further connector portion for connection to a further conductive member, the tubular member being in intimate electrical connection with the surrounding member and remaining in such intimate connection throughout a range of operating temperatures.

30 Claims, 15 Drawing Figures

ELECTRICAL CONNECTOR CONTACTS

The present invention relates generally to electrical connectors and connections and pertains, more specifically, to electrical connector contacts for connecting cable conductors to further conductive members where the cable conductor and further conductive member are constructed of materials having different thermal expansion characteristics within the range of operating temperatures experienced by the connection.

A wide variety of electrical connectors currently are available for the establishment of electrical connections in the field, particularly in the installation of power distribution systems. These connectors generally are made up of component parts which are assembled mechanically at the terminal ends of cables in the system. A typical connector includes a metal contact which is affixed to the conductor of a cable, as by crimping the contact onto the conductor, and an insulating housing surrounding the metal contact. The contact is usually connected mechanically to a further conductive member, which may be in the form of a complementary contact, a further cable conductor, or a like component, to complete a connection.

The preferred material for contacts of the type described is copper or a copper based material since such materials have high mechanical strength as well as good electrical conductivity. Moreover, such materials are compatible with the copper conductors found in the cables utilized in power distribution systems. More recently however, cables have fabricated with aluminum conductors. Because of the differences in the thermal expansion characteristics of the aluminum cable conductor and the copper or copper based materials of the connector contacts, it has been the practice to avoid the use of copper or copper based contacts in connection with aluminum cable conductors.

Furthermore, in any mechanical connections between component parts of different materials, such as aluminum and copper in a connection, difficulties have been experienced which can be traced directly to the differences in thermal expansion characteristics of the different materials in the range of temperatures experienced during operation of the connection. Attempts at providing metal component parts fabricated of materials compatible with each cable type, i.e., aluminum parts for connecting aluminum cables, were not satisfactory since the many attributes of copper component parts were sacrificed. Moreover, no one material was found for the metal component parts of a connector which would be compatible for use with both copper and aluminum cables.

The above problems are discussed in detail in U.S. Pat. No. 3,876,280 which discloses a structure purported to provide a solution to these problems. In that structure a bimetallic connector is constructed by welding an aluminum portion end-to-end with a copper portion, the aluminum portion being provided for receiving an aluminum conductor and the copper portion being threaded for receiving a further copper probe. In such a construction, current is passed between the aluminum portion and the copper portion only through the welded area. The construction requires a relatively costly manufacturing procedure, as well as a careful choice of compatible materials.

It is an object of the present invention to provide an improved electrical connector contact construction employing portions of different materials with different thermal expansion characteristics for attachment to a conductor with given thermal expansion characteristics to enable connection to a further conductive member of different thermal expansion characteristics without failure of the connection over the range of operating temperatures experienced by the connection.

Another object of the invention is to provide an improved electrical connector contact construction of the type described in which a first portion of one material which receives the cable conductor is held captive and confined within a second portion of another material which provides means for connection to the further conductive member.

Still another object of the invention is to provide a contact of the type described and which is compatible with cable conductors of different materials such as, for example, aluminum or copper cables, and is capable of effective service when affixed to either cable so that a contact of a single construction can be supplied for all installations encountered in the field.

Yet another object of the invention is to provide a contact of the type described which attains the advantages of dual metallic construction with a structure that is easily fabricated utilizing economical procedures and readily available materials.

A further object of the invention is to provide a contact of the type described which attains the advantages of dual metallic construction with increased inherent structural strength, as well as increased strength in the connection between the contact and the cable conductor.

A still further object of the invention is to provide a contact of the type described which attains the advantages of dual metallic construction with an increased area for the transfer of current between the joined portions of different materials.

Another object of the invention is to provide a contact of the type described which is readily fabricated in a wide variety of configurations for a wide range of applications in various connections.

The above objects, as well as still further objects and advantages, are attained by the present invention which may be described briefly as an electrical connector contact element capable of being connected to a cable conductor constructed of a material having given thermal expansion characteristics throughout a range of operating temperatures, the contact element comprising: a first portion constructed of a material having thermal expansion characteristics similar to those of the cable conductor, the first portion including means for connecting the conductor to the first portion; a second portion constructed of a material having thermal expansion characteristics different from those of the cable conductor, the second portion including means for connecting the second portion to a further conductive member; and means in the second portion surrounding and capturing the first portion within the second portion such that the first and second portions are in intimate electrical connection and remain in such intimate electrical connection throughout the range of operating temperatures.

The invention will be more fully understood, while still further objects and advantages will become apparent, in the following detailed description of preferred embodiments of the invention illustrated in the accompanying drawing, in which.

Figure 10:
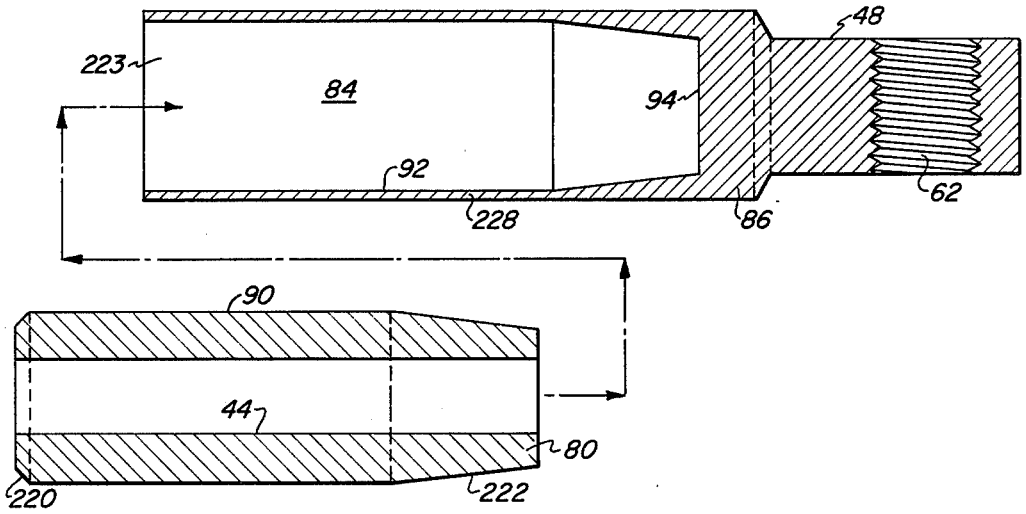
Figure 11:
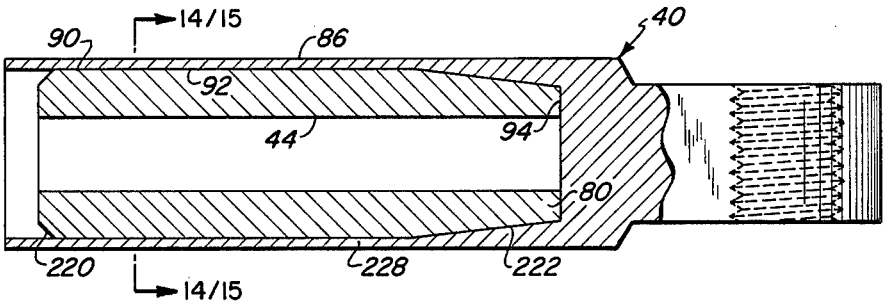
Figure 12:
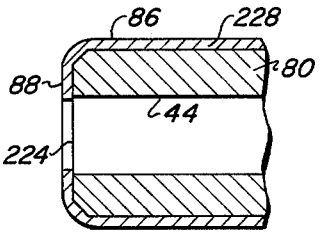
Figure 13:
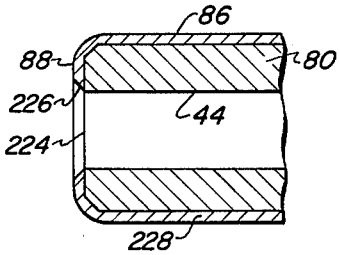
Figure 14:
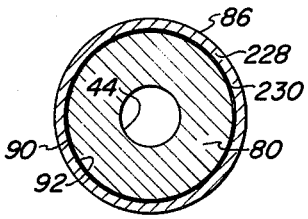
Figure 15:
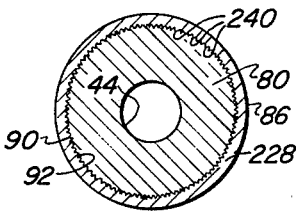

FIGS. 10 through 13 are longitudinal cross-sectional views illustrating a method for making a contact of the invention; and FIGS. 14 and 15 are lateral cross-sectional views taken along line 14/15–14/15 of FIG. 11 and showing alternate constructions.

Figure 1:
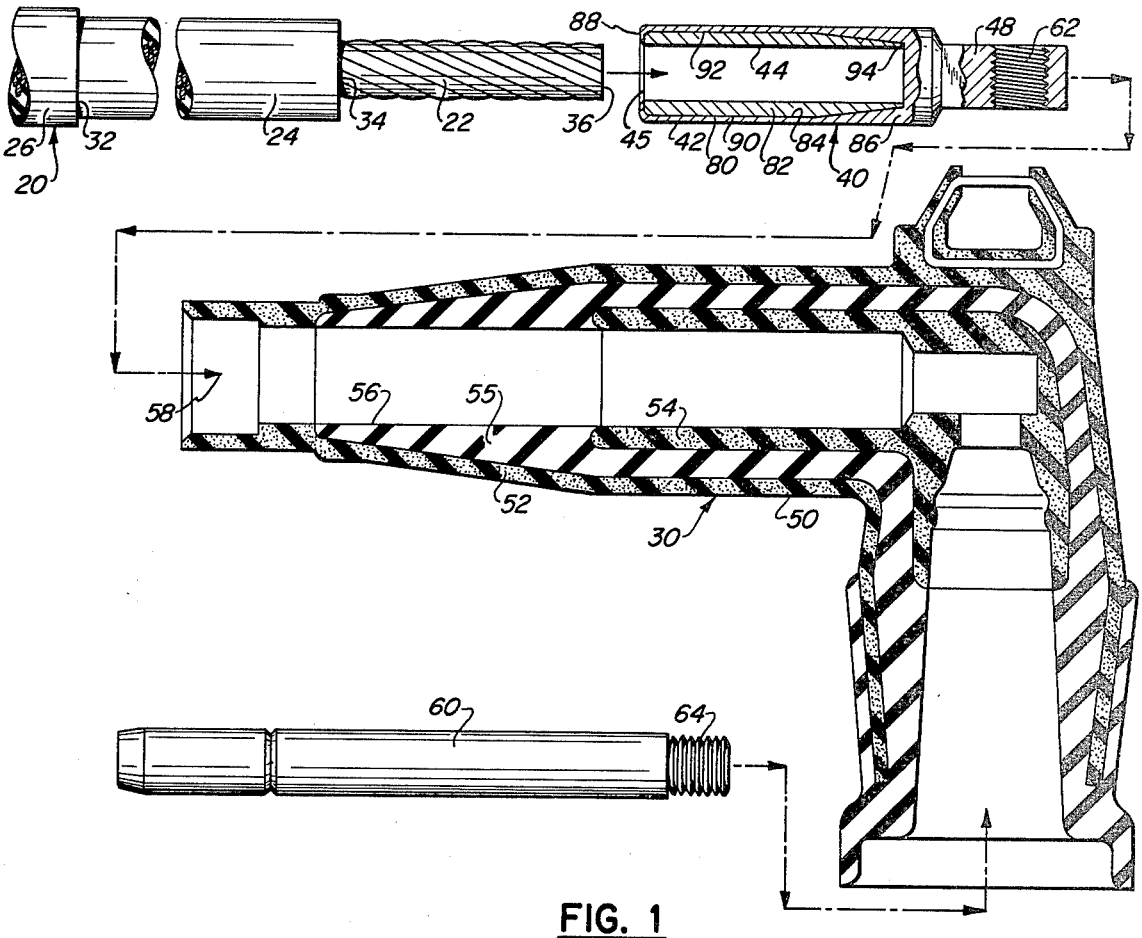
FIG. 1 is an exploded, longitudinal cross-sectional view of an electrical connector about to be attached to the terminal end of an electrical power cable, utilizing a contact element constructed in accordance with the invention.
Figure 2:
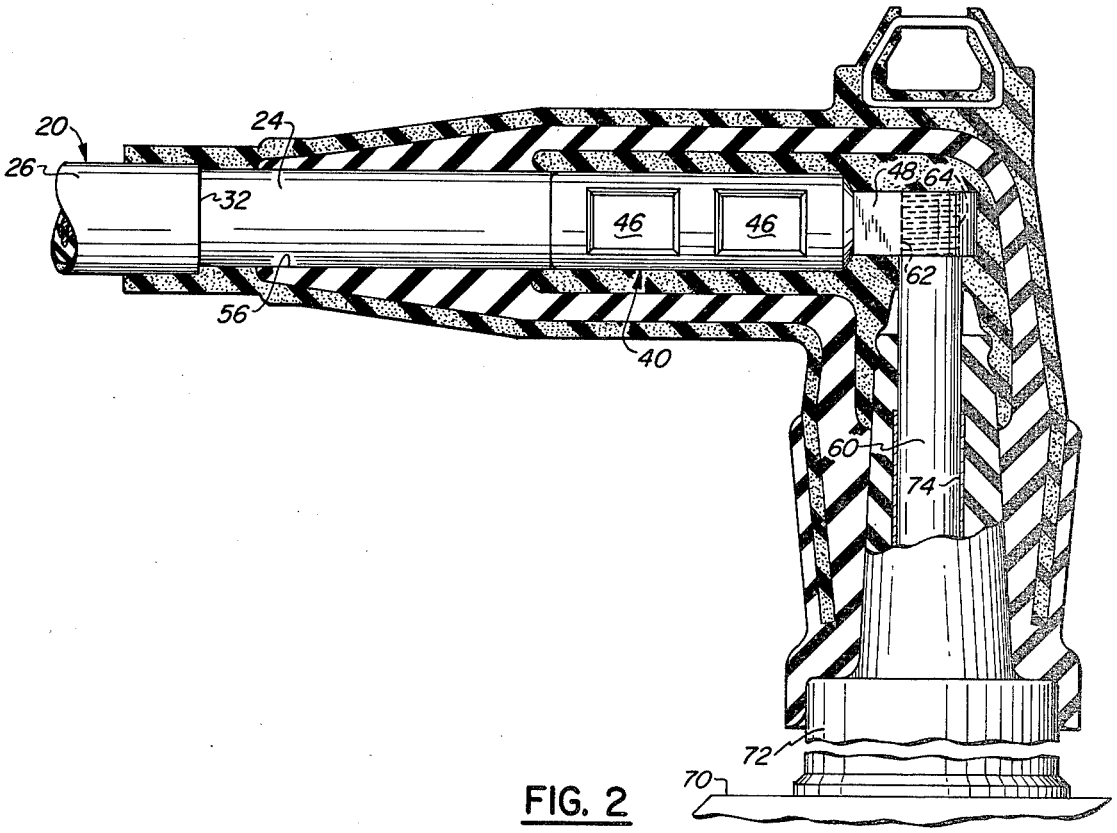
FIG. 2 is a longitudinal cross-sectional view of the electrical connector assembled at the terminal end of the cable.

Referring now to the drawing, and especially to FIGS. 1 and 2 thereof, an electrical cable 20 is shown having a central conductor 22 surrounded by insulation 24 which, in turn, is surrounded by a conductor shield 26. An electrical connector in the form of a connector elbow 30 is to be installed at the terminus of cable 20. The cable terminus has been prepared by terminating the shield 26 at 32 to expose a length of the insulation 24, and the insulation 24 has been terminated at 34 to bare a length of the conductor 22, which terminates at 36.

Connector elbow 30 includes a contact element 40 constructed in accordance with the invention. Contact element 40 has means in the form of a ferrule portion 42 for attaching the contact element 40 to the conductor 22. Thus, ferrule portion 42 includes an internal bore 44 for receiving the bared length of conductor 22 through an opening 45 and, upon placement of the bared length of conductor 22 within bore 44 of ferrule portion 42, the ferrule portion is crimped, as shown at 46 in FIG. 2, to secure the contact element 40 to the cable 20. Contact element 40 includes another portion 48 at the end opposite the ferrule portion 42.

Elbow 30 further includes a sleeve-like composite housing 50 having first and second parts 52 and 54, respectively, of conductive elastomeric material molded integral with a third part 55 of insulating elastomeric material. The terminus of cable 20, with contact element 40 affixed thereto, is inserted into an opening in the form of a bore 56 which extends axially along housing 50, in the direction indicated by the arrowhead 58 in FIG. 1. The cable 20 is advanced within the housing 50 until the housing 50 is properly located on the cable terminus, as illustrated in FIG. 2. When the housing 50 is so located upon the cable 20, a further conductive member in the form of an electrical connector pin 60 is affixed to the contact element 40 to complete the installation. Thus, portion 48 of contact element 40 includes means in the form of a threaded aperture 62 which receives a complementary threaded end 64 of pin 60 to complete the assembly of elbow 30 at the terminus of cable 20. Cable 20 can then be connected to an electrical apparatus, such as a transformer 70, by attaching elbow 30 to a mating connector, such as a common connector bushing 72. In such a connection, connector pin 60 will engage a socket 74 in the bushing 72, as seen in FIG. 2, to complete the electrical connection.

Since socket 74 is usually constructed of copper or a copper based material, that is, a copper alloy such as brass or bronze, connector pin 60 is also fabricated of a copper material having similar thermal expansion characteristics and it is desirable to have at least the portion 48 of the contact element 40 constructed of the same or a similar material so as to preclude any problems which might result from a differential in thermal expansion between the threaded aperture 62 and threaded end 64. Where conductor 22 is a copper conductor, a contact element such as contact element 40 may be fabricated of a copper material, thereby satisfying the need for compatibility among the materials of the conductor, the contact element and the connector pin 60. However, where conductor 22 is constructed of a material having thermal expansion characteristics different from copper materials, such as aluminum, the contact element 40 should be constructed so as to be compatible with the different materials of the conductor 22 and the connector pin 60.

In order to provide contact element 40 with such a compatible construction, ferrule portion 42 includes a first member 80 having a tubular wall 82 received within an internal passage in the form of a cavity 84 in second member 86, which carries the portion 48 of contact element 40. In the illustrated embodiment, first member 80 is constructed of an aluminum material, while second member 86 is constructed of a copper material. The term "aluminum material" is meant to include aluminum and aluminum alloys and the term "copper material" is intended to include copper and copper alloys, such as brass and bronze. The first member 80 is seated within the cavity 84 in second member 86 and is captured therein by means in the form of a laterally or radially inwardly turned lip 88 at one end of the second member 86, with the external or outer surface 90 of first member 80 in intimate electrical connection with the internal or inner surface 92 of second member 86 essentially along the entire length of first member 80. First member 80 is seated against a shoulder 94 located in the second member 86, opposite the lip 88. Upon crimping the contact element 40 at 46 to secure the contact element to the conductor 22, the material of first member 80 will be brought into securing engagement with conductor 22, while the material of second member 86 will remain in surrounding relationship with first member 80. During thermal cycling of the connection between the conductor 22 and the contact element 40, as a result of the range of temperatures experienced by the connection during operation, the similar thermal expansion characteristics of the materials of first member 80 and the conductor 22 will preserve the integrity of the connection therebetween, while the mechanical strength of the assembly between first and second members 80 and 86 will retain the members in the appropriate joined condition. While the first member 80 will tend to expand and contract to a somewhat greater degree than the second member 86, the total confinement of the first member 80 within the second member 86, when the contact element 40 is crimped to the terminal end of cable 20, will preclude deleterious separation of the first and second members 80 and 86 from one another, as well as preventing separation of the contact element 40 from the conductor 22.

The seating of first member 80 within the cavity 84 and the confinement of the first member 80 in the cavity 84 by lip 88 and shoulder 94 assures that the first and second members 80 and 86 will remain integral and in intimate electrical connection. Thus, current can pass between the first and second members 80 and 86 all along the interface between outer surface 90 and inner surface 92, thereby providing a larger area, lower resistance connection between the first and second members. Since the threaded aperture 62 is in the second member 86, a high-strength compatible mechanical connection is available between contact element 40 and connector pin 60.

Figure 3:
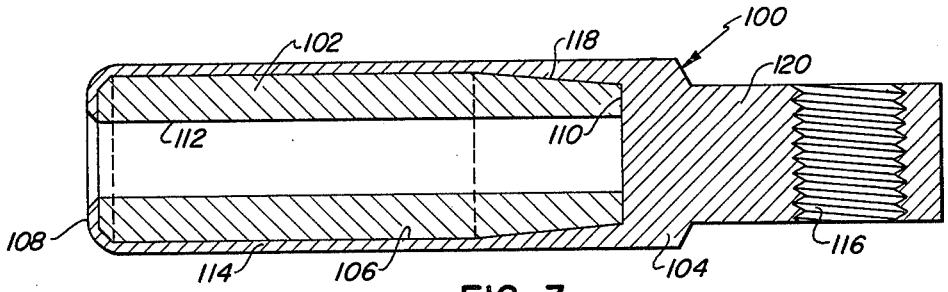
FIG. 3 is an enlarged longitudinal cross-sectional view of a contact constructed in accordance with the invention.

Turning now to FIG. 3, a contact element 100 is shown constructed very similar to contact element 40. An inner tubular member 102, preferably of an aluminum material, is seated within an outer member 104, preferably of a copper material, and captured and confined within a cavity 106 in the outer member. The outer member includes a radially inwardly turned lip 108 and a shoulder 110, between which lip and shoulder the tubular member 102 is held captive. Inner tubular member 102 includes a tubular wall 112 having a radial wall thickness which is greater than the radial wall thickness of the surrounding tubular portion 114 of the outer member 104. In this manner, the mass of inner member 102 is made greater than the mass of tubular portion 114 thereby tending to compensate somewhat for the differences in the coefficients of thermal expansion of the different materials of inner member 102 and outer member 104 so as to reduce the tendency for relative movement as a result of thermal cycling.

Outer member 104 includes a threaded aperture 116 for receiving a further conductive member, such as a threaded pin similar to pin 60. Inner member 102 is tapered slightly at 118 to enable a gradual thinning of the tubular portion 114 in the direction from aperture 116 toward lip 108 so as to provide increased strength along the transition from the solid portion 120 of outer member 104 to the tubular portion 114.

Figure 4:
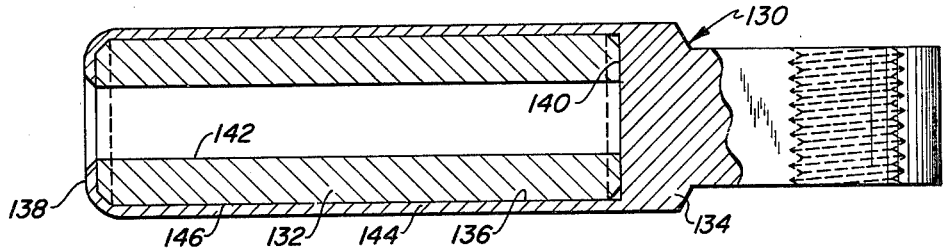
FIG. 4 is a longitudinal view, partially broken away, of another contact constructed in accordance with the invention.

In the embodiment shown in FIG. 4, contact element 130 is very similar in construction to contact element 100 in that a relatively heavy-walled tubular inner member 132 is captured within an outer member 134 and confined within a cavity 136, between a lip 138 and a shoulder 140, with a tubular wall 142 of inner member 132 being surrounded by a relatively thin tubular portion 144 of outer member 134. In this instance, however, inner member 132 has a straight cylindrical external or outer surface 146, without a taper as found in the earlier-described embodiment, the material of outer member 134 being strong enough to maintain the desired structural integrity without increasing the wall thickness of tubular portion 144, thereby attaining a slightly enhanced balance of the masses of tubular inner member 132 and tubular portion 144.

Referring now to FIGS. 5 through 9, several further embodiments are illustrated in which the contact elements each include inner and outer members of different materials, while having a variety of configurations for making an electrical connection to a further conductive member.

Figure 5:
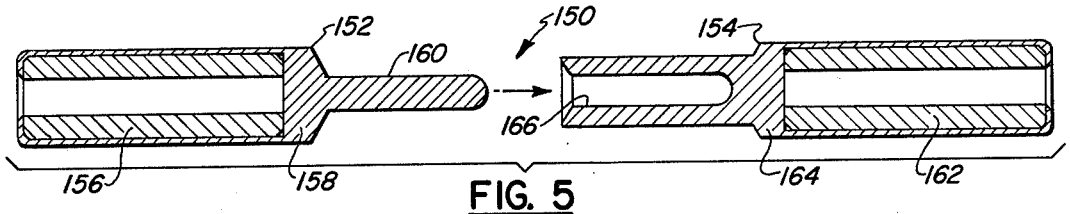
FIGS. 5 through 9 are longitudinal cross-sectional views of different contacts illustrating alternate embodiments of the invention.

In FIG. 5, a pin and socket connector 150 has mating contact elements 152 and 154. Contact element 152 has an inner member 156 of an aluminum material captured and confined within an outer member 158 of copper material. Outer member 158 includes a unitary connector pin 160. Contact element 154 has an inner member 162 of an aluminum material captured and confined within an outer member 164 of a copper material. Outer member 164 includes a unitary conductor socket 166 complementary to connector pin 160. Connector 150 enables the connection of aluminum conductors with a connector which provides the advantageous characteristics of a copper material in a pin and socket connection.

Figure 6:
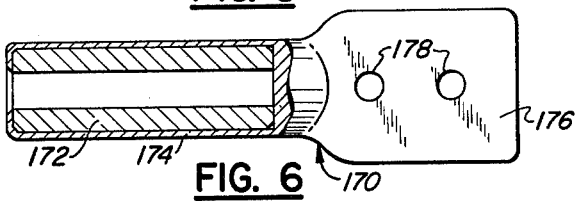

In FIG. 6, a contact element is shown in the form of a lug 170 in which an inner member 172 of an aluminum material is captured and confined within an outer member 174 of a copper material. Outer member 174 includes a flattened lug portion 176 having apertures 178 for enabling connection to a further conductive member. Lug portion 176 thus is a copper material compatible with further conductive members of copper material.

Figure 7:
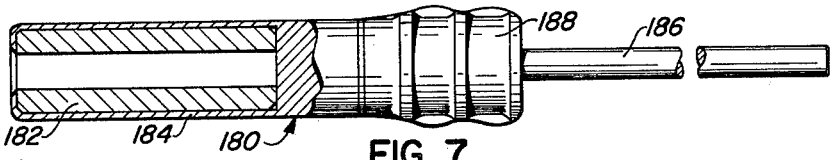

In FIG. 7, a contact element is shown in the form of a terminal connector 180 for a terminator. An inner member 182 of an aluminum material is captured and confined within an outer member 184 of a copper material. A rod connector 186 is affixed to the outer member 184 by a crimped connection at 188.

Figure 8:
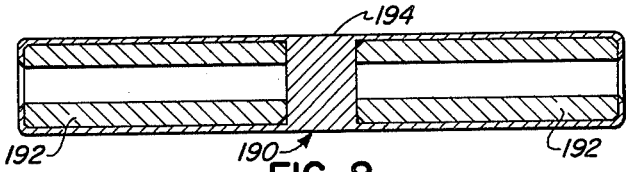

In FIG. 8, a contact element is shown in the form of a splice connector 190 in which first and second inner members 192 of an aluminum material are captured and confined within a common outer member 194 of a copper material for receiving the terminal ends of conductors to be joined together in a splice connection. Here, the strength and conductivity of copper are available to interconnect aluminum conductors.

Figure 9:
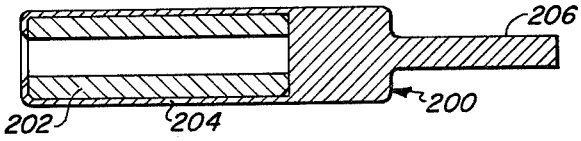

In FIG. 9, a contact element is shown in the form of a terminal connector 200 in which an inner member 202 of an aluminum material is captured and confined within an outer member 204 of a copper material. Outer member 204 includes a unitary terminal 206 which provides the advantages of a copper material terminal at the terminus of an aluminum conductor.

All of the embodiments described above are usable in connection with copper conductors as well as with aluminum conductors. Thus, contact elements having the above-described construction can be supplied for making a wide variety of connections in the field between any combination of copper and aluminum conductors. Since the contact elements are compatible with either copper or aluminum conductors, there is no need to supply different contact element constructions for different conductors, thereby simplifying inventories and ensuring that all connections will be of uniform quality without concern for choosing the correct connector element.

Turning now to FIGS. 10 through 13, there is illustrated a method for making contact element 40. First member 80 is fabricated by cutting a length from an extruded tube of aluminum material and then machining the cut length to establish a chamfer 220 at one end and a taper 222 at the other end. Second member 86 is drawn to establish the cavity 84, which is open at 223. Portion 48 is formed, drilled and tapped to establish the desired shape and the threaded aperture 62, all as seen in FIG. 10.

First member 80 is pressed into cavity 84 of second member 86, with the relative dimensions of the mating outer and inner surfaces establishing an interference fit between the outer surface 90 of first member 80 and the inner surface 92 of second member 86, until the first member is seated within the second member against shoulder 94, as seen in FIG. 11.

The end of the second member which is axially opposite shoulder 94 and extends axially beyond the first member 80, as seen in FIG. 11, is then deformed radially inwardly to the configuration shown in FIG. 12, thereby forming lip 88 for capturing and confining the first member within the second member.

The opening or entrance 224 to internal bore 44 is then chamfered, as shown at 226 in FIG. 13, to complete the assembly.

It is desirable to anneal the relatively thin tubular wall portion 228 of the second member 86 to prevent cracking of that wall portion when the contact element 40 is crimped to connect the contact element to the conductor 22. However, such annealing should be confined to tubular wall portion 228 so as to retain hardness at the threaded aperture 62. The additional cold working accomplished by establishing lip 88 as described will harden lip 88 and provide added strength for confining first member 80 within second member 86.

In order to assure optimum electrical contact between the outer surface 90 of the first member 80 and the inner surface 92 of the second member 86, outer surface 90 may be plated, prior to insertion of member 80 into member 86, to inhibit the oxidation of outer surface 90. Thus, as seen in FIG. 14, a layer 230 of plating material will assure intimate contact and a good electrical connection between outer surface 90 and inner surface 92. Suitable plating materials are tin, indium, cadmium and zinc.

As an alternative to plating, the inner surface 92 can be provided with longitudinal serrations 240, as seen in FIG. 15. Upon insertion of the first member 80 into the second member 86, the relatively hard serrations will bite through any oxide layer on the outer surface 90 to make a good electrical connection with the aluminum material of the first member 80.

It is to be understood that the above detailed description of embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. An electrical connector contact element capable of being connected to a cable conductor constructed of a material having given thermal expansion characteristics throughout a range of operating temperatures, the contact element comprising:

a first portion constructed of a material having thermal expansion characteristics similar to those of the cable conductor, the first portion having a prescribed length and including means for connecting the conductor to the first portion;

a second portion constructed of a material having thermal expansion characteristics different from those of the cable conductor, the second portion including means for connecting the second portion to a further conductive member; and means in the second portion surrounding and capturing the first portion within the second portion essentially along the entire length of the first portion such that the first and second portions are in intimate electrical connection and remain in such intimate electrical connection throughout the range of operating temperatures.

2. The invention of claim 1 wherein:

the first portion is generally tubular and has an outer surface, the first portion including an internal bore for receiving the cable conductor; and the second portion has an internal passage for receiving the first portion therein, the internal passage having an inner surface such that the outer surface of the first portion is in intimate contact with the inner surface of the second portion along the internal passage.

3. The invention of claim 2 wherein:

the internal passage extends longitudinally within the second member between opposite ends and has an opening at one of said ends for receiving the first portion therein; and the second portion includes a shoulder adjacent the opposite end of the internal passage for receiving the first portion in abutment therewith.

4. The invention of claim 3 wherein the second portion includes a laterally inwardly extending lip at said one of the opposite ends of the internal passage, the lip engaging the first portion to confine as well as capture the first portion between the shoulder and the lip.

5. The invention of claim 1, 2, 3, or 4 wherein the first portion is constructed of an aluminum material and the second portion is constructed of a copper material.

6. The invention of claim 1, 2, 3, or 4 wherein:

the first portion includes a first tubular wall extending longitudinally therealong;

the second portion includes a second tubular wall extending longitudinally therealong and juxtaposed with the first tubular wall; and the lateral thickness of the first tubular wall is different from the lateral thickness of the second tubular wall so as to tend to compensate for the difference in thermal expansion characteristics of the materials of the first and second tubular walls.

7. The invention of claim 6 wherein the lateral thickness of the first tubular wall is greater than the lateral thickness of the second tubular wall.

8. The invention of claim 7 wherein the first portion is constructed of an aluminum material and the second portion is constructed of a copper material.

9. An electrical connector contact element capable of being connected to a conductor, said contact element comprising:

a first member of a metal having a first coefficient of thermal expansion, the first member having a prescribed axial length and a generally tubular wall including an external surface extending axially between opposite ends;

a second member of a metal having a second coefficient of thermal expansion different from the first coefficient of thermal expansion, the second member extending axially between opposite ends and including a cavity having an internal surface extending axially from one of the opposite ends toward the other of the opposite ends;

the first member being seated within the cavity of the second member with essentially the entire length of the first member within the cavity of the second member and the external surface of the first member in intimate contact with the internal surface of the second member;

means capturing the first member within the cavity of the second member;

an opening at said one end of the second member for enabling placement of the conductor within the tubular wall of the first member; and connector means in the second member for connecting the second member to a further conductive member.

10. The invention of claim 9 wherein the second member includes a shoulder adjacent the opposite end, the first member abutting the shoulder.

11. The invention of claim 10 wherein the means capturing the first member within the cavity of the second member includes a radially inwardly turned lip at said one of the opposite ends of the second member, the lip engaging the first member to confine as well as capture the first member between the shoulder and the lip.

12. The invention of 9, 10 or 11 wherein the first member is constructed of an aluminum material and the second member is constructed of a copper material.

13. The invention of claim 9, 10 or 11 wherein:

the second member includes a tubular wall portion juxtaposed with the tubular wall of the first member; and the radial thickness of the tubular wall of the first member differs from the radial thickness of the tubular wall portion of the second member so as to tend to compensate for the difference between the first and second coefficients of thermal expansion.

14. The invention of claim 13 wherein the thickness of the tubular wall of the first member is greater than the thickness of the tubular wall portion of the second member.

15. The invention of claim 14 wherein the first member is constructed of an aluminum material and the second member is constructed of a copper material.

16. The invention of claim 9, 10 or 11 wherein the external surface of the first member includes a layer of electrically conductive oxidation-inhibiting material.

17. The invention of claim 16 wherein the first member is constructed of an aluminum material and the second member is constructed of a copper material.

18. The invention of claim 9, 10 or 11 wherein the relative radial dimensions of the external surface of the first member and the internal surface of the cavity in the second member establish an interference fit between the first member and the second member.

19. The invention of claim 9, 10 or 11 wherein the internal surface of the second member includes longitudinal serrations which bite into the external surface of the first member to enhance the electrical connection between the internal surface and the external surface.

20. The invention of claim 19 wherein the first member is constructed of an aluminum material and the second member is constructed of a copper material.

21. The invention of claim 9, 10 or 11 wherein the connector means includes a threaded aperture.

22. The invention of claim 9, 10 or 11 wherein the connector means includes a connector pin.

23. The invention of claim 9, 10 or 11 wherein the connector means includes a connector socket.

24. The invention of claim 9, 10 or 11 wherein the connector means includes a lug.

25. The invention of claim 9, 10 or 11 wherein the connector means includes a rod crimped to the second member.

26. The invention of claim 9, 10 or 11 wherein the connector means includes a terminal unitary with the second member.

27. The invention of claim 9 wherein the further conductive member comprises a further conductor and the connector means includes:

a second cavity in the second member, said second cavity having a further internal surface extending axially from the other of the opposite ends toward said one end of the second member;

a third member of a metal having a coefficient of thermal expansion different from the second coefficient of thermal expansion, the third member having a generally tubular wall including an external surface extending axially between opposite ends;

the third member being seated within the second cavity with the external surface of the third member in intimate contact with the further internal surface;

means capturing the third member within the second cavity of the second member; and a further opening at the end of the second member opposite to said one end for enabling placement of the further conductor within the tubular wall of the third conductor member.

28. The invention of claim 27 wherein the second member includes a first shoulder spaced from one of the opposite ends of the second member, and a second shoulder spaced from the other of the opposite ends of the second member, the first member abutting the first shoulder and the third member abutting the second shoulder.

29. The invention of claim 28 wherein:

the means capturing the first member within the first said cavity of the second member includes a radially inwardly turned first lip at said one of the opposite ends of the second member, the first lip engaging the first member to confine as well as capture the first member between the first shoulder and the first lip; and the means capturing the third member within the second cavity of the second member includes a radially inwardly turned second lip at said other of the opposite ends of the second member, the second lip engaging the third member to confine as well as capture the third member between the second shoulder and the second lip.

30. The invention of claim 29 wherein the first and third members are constructed of an aluminum material and the second member is constructed of a copper material.

* * * * *